US007095869B2

(12) United States Patent
Button

(10) Patent No.: US 7,095,869 B2
(45) **Date of Patent: *Aug. 22, 2006**

(54) LOUDSPEAKER COIL SUSPENSION SYSTEM

(75) Inventor: Douglas J. Button, Simi Valley, CA (US)

(73) Assignee: Harman International Industries, Inc., Northridge, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/931,693

(22) Filed: Aug. 31, 2004

(65) Prior Publication Data

US 2005/0025331 A1 Feb. 3, 2005

Related U.S. Application Data

(62) Division of application No. 09/921,191, filed on Jul. 31, 2001, now Pat. No. 6,801,634.

(60) Provisional application No. 60/221,693, filed on Jul. 31, 2000.

(51) Int. Cl.
*H04R 25/00* (2006.01)

(52) U.S. Cl. ..... 381/423; 381/343; 381/398; 381/407

(58) Field of Classification Search ..... 381/340, 381/343, 398, 423, 424, 430, 403, 404, 405, 381/407; 181/164, 165, 171, 172, 173, 157, 181/159

See application file for complete search history.

(56) References Cited

U.S. PATENT DOCUMENTS 2,392,143 A 11/1942 Graham
3,616,529 A 11/1971 Iding
3,873,784 A 3/1975 Doschek
4,433,214 A 2/1984 Jasinski
4,532,383 A 7/1985 Willy
5,157,731 A 10/1992 Mitobe
5,883,967 A 3/1999 House
6,154,556 A 11/2000 Takahashi et al.

FOREIGN PATENT DOCUMENTS

EP 1 531 791 11/1978

*Primary Examiner*—Huyen Le

(57) ABSTRACT

The invention provides a continuous layer of polymer that is shaped to act as the suspension, the former, and an attachment to the diaphragm. The coil may be located within the pocket providing insulation to the coil thus preventing electrical short circuiting of the voice coil as the voice coil expands or contracts based on its operating temperature. The invention also provides an inner flange area of a suspension that may act as a spring generating additional acoustic energy from the compression driver. The inner flange area may also be tuned to vibrate at a predetermined high frequency. Thus, in certain applications, where more acoustic energy is desired at high frequency, the inner flange area may be tuned to provide that extra acoustic energy. To further increase the high frequency energy generated by the compression driver, the diaphragm may be coupled to the bottom side of the inner flange area. Such an arrangement places the diaphragm closer to the phasing plug to minimize the space or cavity between the two. With a smaller cavity, the resonance in the cavity increases, so that the compression driver generates more energy at high frequency.

14 Claims, 5 Drawing Sheets

FIG. 2
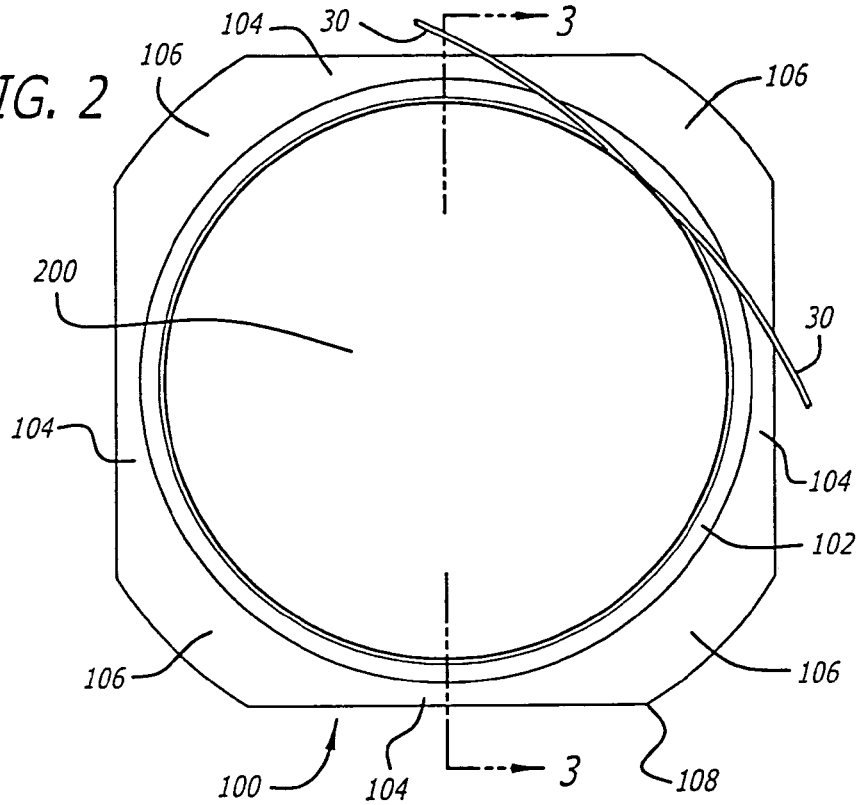
FIG. 3
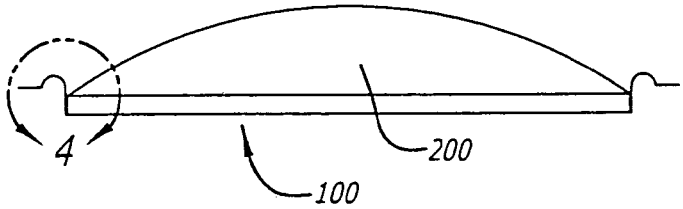
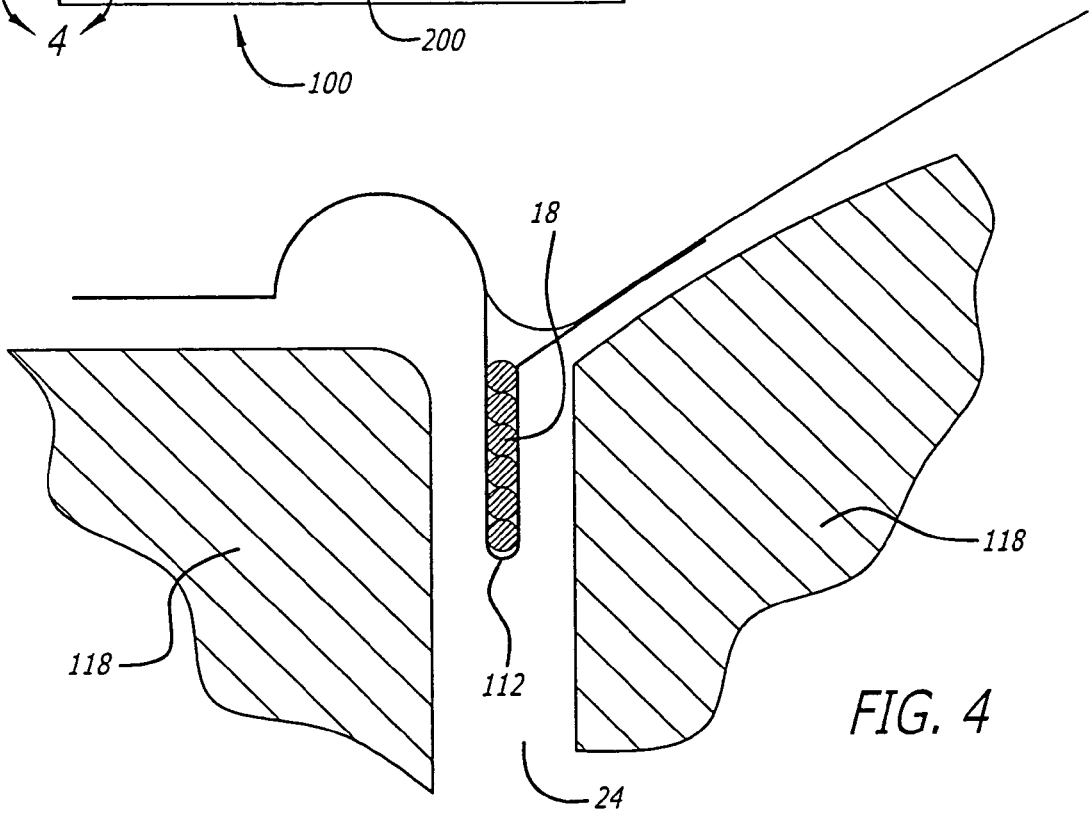
FIG. 4

LOUDSPEAKER COIL SUSPENSION SYSTEM

RELATED APPLICATIONS

This is a divisional of U.S. patent application Ser. No. 09/921,191, filed Jul. 31, 2001 now U.S. Pat. No. 6,801,634, which is hereby incorporated by reference, which claims priority to U.S. Provisional Patent Application Ser. No. 60/221,693 filed Jul. 31, 2000.

BACKGROUND OF THE INVENTION

1. Field of the Invention

This invention relates to a loudspeaker coil suspension and dome system that acts to protect the coil from electrical shorting.

2. Related Art

A loudspeaker is a device for converting variations of electric energy into corresponding variations of acoustic energy. To convert the electrical energy into sound, a combination of a diaphragm and a compression driver is coupled to the throat of a horn. The compression driver typically includes a phasing plug made of ferromagnetic material having a plurality of bores between the rear side and the front side of the phasing plug.

Generally, the coil is wrapped around the exterior side of a cylindrically shaped former. The combination of the former and coil are then disposed within an annular magnetic gap enabling free vibration in a direction along the longitudinal axis of the former. The vibration causes a corresponding vibration of the diaphragm generating sound. The suspension needs to flexible in order to accommodate the excursion of the cone or diaphragm. At the same time, the suspension needs to keep the cone or diaphragm from tipping or becoming "de-centered."

To suspend the diaphragm adjacent to the rear side of the compression driver, the outer perimeter of the diaphragm is coupled to a suspension, which in turn is attached to a mounting plate. With the configurations that have been used in the past, the outer surface of the voice coil is substantially exposed and not insulated.

To generate sound, a static magnetic field, usually produced by a permanent magnet, is applied so that an alternating signal current flowing through the voice coil causes it to vibrate along its cylindrical axis. This in turn causes the diaphragm to vibrate along the axis of the plurality of bores and generate sound waves corresponding to the signal current. The sound waves are directed through the bores toward the front side, which then radiates the sound waves into the air through the horn.

Despite best manufacturing efforts, speakers may fail due to excessive mechanical and thermal stresses. For example, suspensions can fail due to environmental factors such as exposure to heat, UV rays or humidity. Adhesives attaching the suspension to the diaphragm can also fail if applied improperly or if excess mechanical stress is applied to the jointing area. Likewise, adhesives attaching the former to the diaphragm can fail. This happens because applying adhesive between the suspension and the diaphragm, and between the former and the diaphragm, can be a delicate process and possibly misapplied. Another way the loudspeaker might fail is due to over heating of the voice coil. If the voice coil experiences excessive heat expansion, it may come into contact with the sidewalls of the magnetic gap. If this condition occurs and the voice coil is not insulated, the resulting contact between the voice coil and the sidewalls can cause an electrical short circuit and terminal failure will occur.

Another shortcoming of current compression driver devices is that additional acoustic energy may not be provided in high frequency applications. In high frequency applications, additional acoustic energy is desired from the compression driver, but with current designs such additional acoustic energy may not be provided. Therefore, there is a need for a compression driver that can generate additional acoustic energy at high frequency application, a coil and suspension assembly system whose manufacturing process is simplified and a system for protecting the voice coil from experiencing electrical short circuits.

SUMMARY

This invention provides an assembly system for a voice coil, suspension, and diaphragm. In one embodiment of the invention, a continuous layer of high temperature resistant polymer is shaped to form a suspension, a pocket adapted to-receive the voice coil and a flange adapted to couple to the diaphragm. A continuous layer of polymer may be shaped to perform several functions, such as the suspension, the former, and an attachment to the diaphragm. The coil may be inserted inside the pocket to protect the voice coil from electrical shorting as the voice coil expands or shrinks. The assembly system may also allow for the manufacture of different products via simply changing the diaphragm material. The diaphragm can then be optimized for different uses by changing materials. This may provide manufacturing flexibility by allowing various products to be assembled by the same tooling.

This invention may also allow utilization of an inner flange area of a suspension to act as a spring allowing the generation of additional acoustic energy from the compression driver. The inner flange area may be tuned to vibrate at a predetermined high frequency thus adding additional acoustic energy to the diaphragm motion. In certain applications where more acoustic energy is desired, the inner flange area may be tuned to provide that extra acoustic energy.

To further increase the high frequency energy generated by the compression driver, the diaphragm may be coupled to the bottom side of the inner flange area. Such an arrangement places the diaphragm closer to the phasing plug minimizing the space or cavity between the two items. With a smaller cavity, the resonance in the cavity increases, resulting in an increase in the high frequency energy generated by the compression driver.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

FIG. 2 is a top view of a unitary suspension pocket attachment.

FIG. 3 is a cross-sectional view along line 3—3 in FIG. 2.

FIG. 4 is a close-up cross-sectional view along an encircled area 4 in FIG. 3 illustrating a pocket disposed within a voice coil gap.

DETAILED DESCRIPTION OF THE PREFERRED EMBODIMENTS

Figure 1:
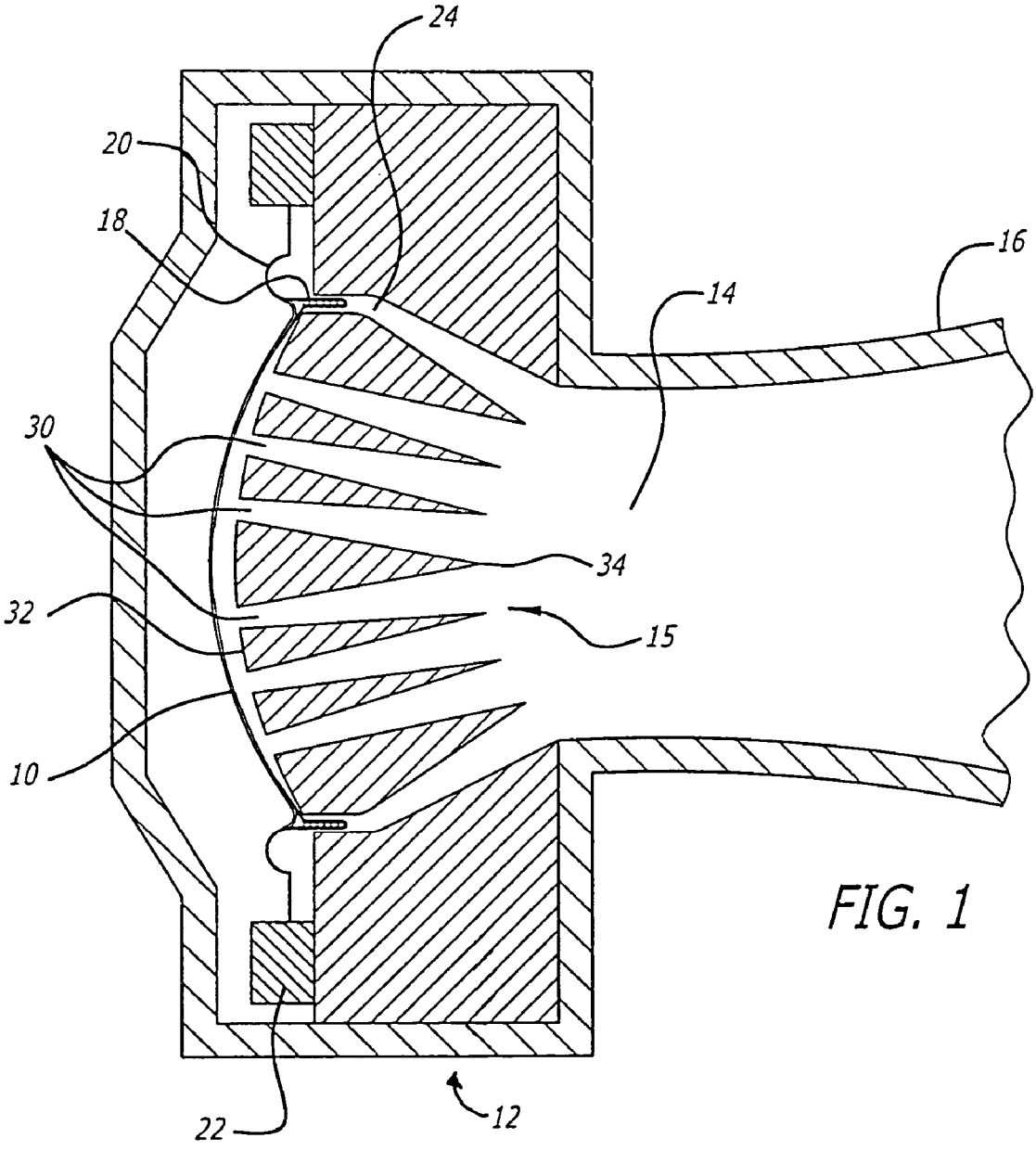
FIG. 1 is a cross-sectional view of a compression driver.

FIG. 1 illustrates a cross sectional view of a compression driver 12 coupled to the throat 14 of a horn 16. To convert the electrical energy into sound, a combination of a diaphragm 10 and a phasing plug 15 is coupled to the throat 14 of a horn 16. The phasing plug 15 may be made of ferromagnetic material that has a plurality of bores 30 between the rear side 32 and the front side 34. The coil 18 is insulated and disposed within an annular magnetic gap 24 to vibrate freely in a direction along the longitudinal direction. To suspend the diaphragm 10 adjacent to the rear side 32 of the phasing plug 15, the outer perimeter of the diaphragm 10 is coupled to a suspension 20, which in turn is attached to a mounting plate 22.

FIGS. 2–6 illustrate a unitary suspension pocket attachment ("USPA") 100. The USPA 100 performs several functions, including: (1) acting as a suspension or compliance to accommodate the excursion of the diaphragm; (2) acting as a voice coil former; (3) attachment to a diaphragm or dome; and (4) voice coil overdrive protection.

FIG. 2 illustrates a top view of the USPA 100 having an inner flange areas 102 substantially forming a circular opening adapted to couple to a diaphragm 200. The USPA 100 also has outermost flange areas 106 adapted to couple to a mounting plate. And the intermediate outer flange areas 104 are free to move along the longitudinal axis and move with the vibration of the diaphragm 200. That is, in this embodiment, the USPA 100 has an outer perimeter outline 108 that is substantially square with its corners rounded off. Disposed within the USPA 100 is a voice coil having two lead wires 30 extending from the USPA 100. Other outer perimeter outlines may be configured by one skilled in the art.

FIG. 3 illustrates by way of example a cross-sectional view along a line 3—3 in FIG. 2. In particular, FIG. 3 shows the diaphragm 200 having a dome shape coupled to the USPA 100. FIG. 4 illustrates, an enlarged view of the encircled area 4 in FIG. 3. In this embodiment, the voice coil 18 is disposed within the pocket 112, which insulates the voice coil 18 from the sidewalls 118 forming the voice coil gap 24. That is, the pocket 112 allows the voice coil 18 to expand or contract without shorting out the voice coil thereby preventing a terminal failure.

Figure 5:
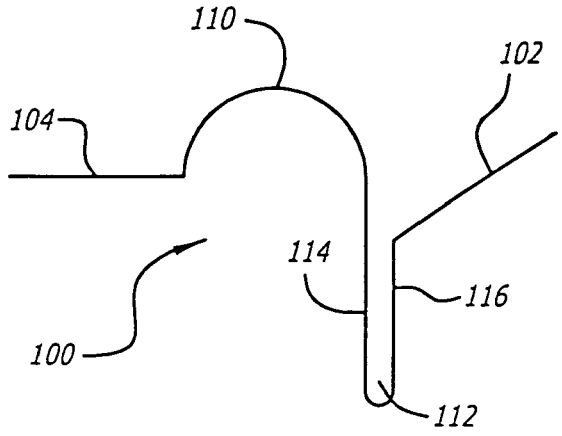
FIG. 5 is a cross-sectional view of a unitary suspension pocket attachment of the embodiment illustrated in FIG. 4.

FIG. 5 illustrates the USPA 100 comprised of several portions, including the intermediate outer flange area 104, a half-roll 110, a pocket 112, and the inner flange area 102, all continuous one piece. In particular, the pocket 112 may form a deep U shape, defined by an outer wall 114 and an inner wall 116. In this embodiment, the intermediate outer flange area 104 is free to vibrate as the diaphragm vibrates along the longitudinal axis. In other cross-sectional views, the intermediate outer flange area 104 may be the outermost flange area 106 that is adapted to couple to the mounting plate 22 as illustrated in FIG. 1.

From left to right in FIG. 5, the intermediate outer flange area 104 transitions to form the half-roll portion 110, which is shaped like a dome. The dome shape allows the half-roll 110 to act like a spring. Moreover, the half-roll portion 110 needs to be flexible in order to accommodate the excursion of the cone or diaphragm. At the same time, it is adapted to keep the cone or diaphragm from tipping or becoming "de-centered." The half-roll portion 110 is not limited to the dome shape described above, and may take on different shape as known to one skilled in the art.

The half-roll 110 then transitions to form the pocket 112, which may be shaped like a deep U, the pocket 112 then transitions to form the inner flange area 102. The pocket 112 may be adapted to hold a voice coil within the pocket 112 between the outer wall 114 and the inner wall 116. This positioning also insulates the side walls 118 that form the magnetic gap 24. This allows the voice coil 18 to expand or contract without shorting out because the pocket's side walls 114, 116 protect the voice coil from electrically contacting the steel walls 118 of the compression driver 12. With the USPA 100, there is no need to manufacture a separate former, which reduces the cost of manufacturing the loudspeaker. The inner flange area 102 extends from the USPA 100 and provides more secure attachment because there is more surface area between the flange 102 and the diaphragm 10 in which to apply the adhesive more evenly.

The curvature of the diaphragm 10 may vary depending on the application. One of the advantages of the invention is that diaphragm (or sometimes referred to as a dome) of different curvature can be placed in the USPA 100. For instance, the steeper in curvature the dome is or smaller the radius of the dome, stiffer the dome becomes, i.e., higher in the frequency resonance modal behavior. On the other hand, as the curvature flattens or as the radius of the dome gets greater, there may be more resonance in the response.

A variety of methods known to one skilled in the art may be used to bond the USPA 100 to the diaphragm 10. For example, adhesives such as epoxy may be used to bond the USPA 100 to the diaphragm 10. With regard to the USPA 100, a variety of materials known to one skilled in the art or developed in the future may be used. For example, a variety of flexible plastic materials may be used, such as a polyimide such as KAPTON® polyimide. Other metal material such as aluminum may be used as well. The USPA 100 as configured in FIG. 5, may be manufactured by Mogami Denki Corporation, 954-1 Manurogawa, Mogami-Gun, Yamagata, 999-53 Japan, using plastics such as KAPTON® polyimide. Furthermore, a diaphragm made of a variety of materials may be used in conjunction with the USPA 100 to create different sound. For example, a diaphragm made of plastic, carbon fiber, titanium, beryllium, and aluminum, may be used with the USPA 100 depending on the application. U.S. Pat. No. 5,883,967 entitled "Slotted Diaphragm Loudspeaker" issued to William Neal House, assigned to Harman International Industries, discussed a variety of other methods of constructing a diaphragm, which is hereby incorporated by reference to this application.

Figure 6:
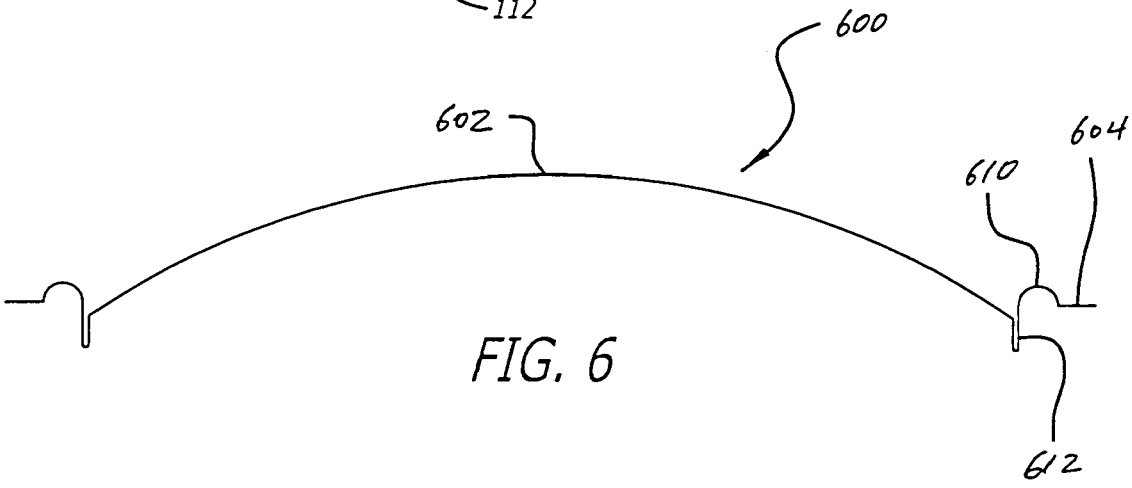
FIG. 6 is a cross-sectional view of a unitary diaphragm pocket suspension.

FIG. 6 is a cross-sectional view of another embodiment of the invention, having a unitary diaphragm pocket suspension ("UDPS") 600. In this embodiment, the diaphragm 602, the pocket 612, the half-roll 610, and the outer flange 604 may be made of one piece. With this embodiment, the inner flange may extend to form the diaphragm 602. This configuration minimizes the manufacturing costs because the flange no longer needs to be bonded to the diaphragm 602. When adhesive is used to couple the flange to the diaphragm, there may be variations in applications of the adhesive. Such variations can cause differing stiffness, mass, dampening characteristics, be difficult to control, and may result in variations in the frequency response of the loudspeakers. However, with this embodiment, there is no need for adhesive to bond the flange to the diaphragm 602. With regard to material, a variety of materials may be used, that is, the UDPS 200 may be made of plastic such as KAPTON® polyimide and aluminum.

Figure 7:
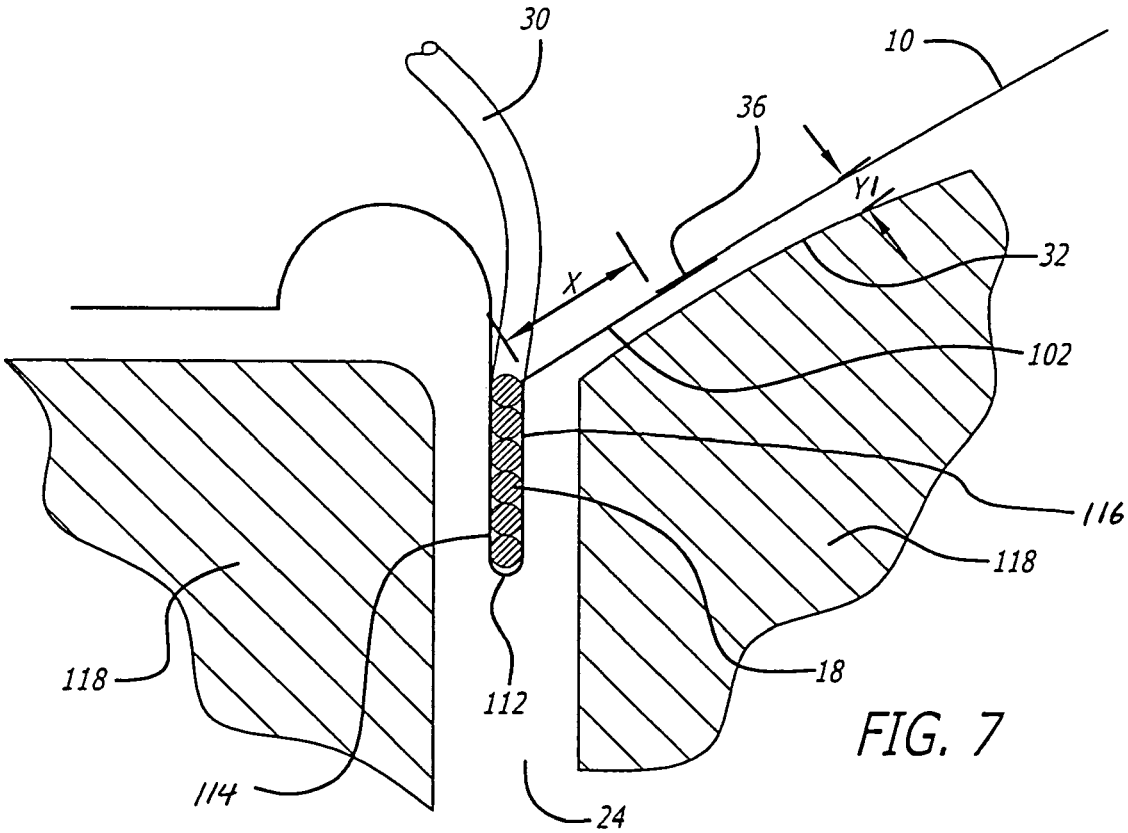
FIG. 7 is a close-up cross-sectional view of an inner flange being coupled to a diaphragm.

FIG. 7 illustrates yet another aspect of the invention, utilizing an inner flange area 102 to act as a spring to generate additional acoustic energy from the compression driver. That is, the diaphragm 10 may be coupled to the inner flange 102 at a predetermined distance X from the inner wall 116. As such, the diaphragm 10 and the inner flange 102 are coupled to each other between the contact area 36. By varying the distance X in which the diaphragm is coupled to the inner flange 102, the inner flange 102 can be tuned to act like a spring so that it can vibrate at a certain high frequency resonance. This way, the inner flange 102 can be tuned to vibrate at a high frequency resonance to add additional acoustic energy to the compression driver. In other words, as the inner flange resonates at certain high frequencies, the vibration of the flange 102 adds to the back and forth stroke motion of the voice coil 18 thereby adding energy to the vibration of the diaphragm 10. Thus, in certain applications where more power is desired from the compression driver as in a rock and roll concert, the above described embodiment may be used to add additional acoustic energy. Note that as the predetermined distance X gets shorter, the inner flange 102 acts like a stiffer spring so that the inner flange 102 will resonate at a higher frequency.

Figure 8:
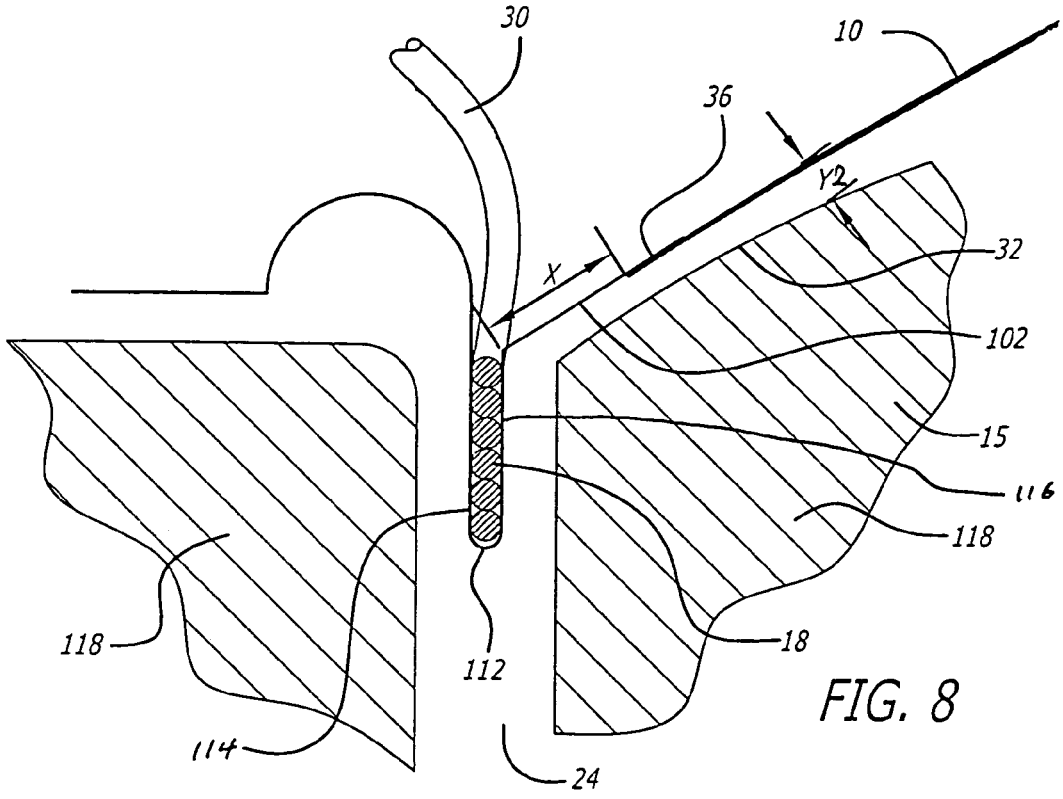
FIG. 8 is a close-up cross-sectional view of an alternative embodiment illustrating an inner flange being coupled to a diaphragm.

FIG. 8 illustrates still another alternative embodiment of the invention where the diaphragm 10 is coupled to the under side of the inner flange 102 at a predetermined distance X away from the inner wall 116. With the diaphragm 10 coupled to the under side of the inner flange 32, the diaphragm 10 is closer to the rear side 32 of the phasing plug 15 so that the gap Y2 between the diaphragm 10 and the rear side 32 here is less than the gap Y1 in the embodiment illustrated in FIG. 7 with the diaphragm on the top side of the inner flange 102. There are several advantages to this embodiment. First, the diaphragm is further away from the lead wire 30 so that they are further isolated from one another. Accordingly, there is less risk of the lead wire 30 and the diaphragm 32 coming into contact and causing a short. Secondly, in this embodiment the diaphragm 10 is closer to the rear side 32 of the phasing plug 15 to generate additional high frequency energy from the compression driver. In other words, because there is less cavity space between the diaphragm 10 and the rear side 32, the cavity resonates at a higher frequency to provide additional energy through the compressor driver. However, the distance Y2 should be wide enough so that the diaphragm 10 does not come into contact with the rear side 32 when operating at low frequencies, which may cause a short under such circumstances.

Figure 9:
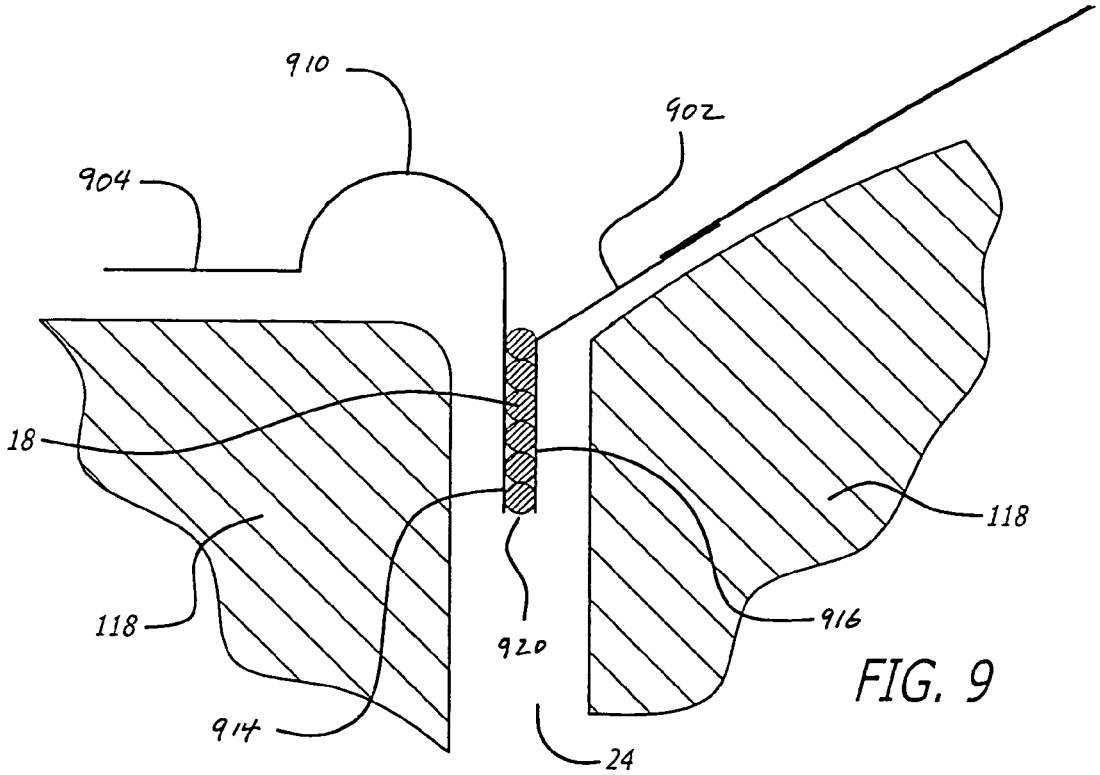
FIG. 9 is a cross-sectional view of an alternative embodiment of a pocket insulating a voice coil.

FIG. 9 illustrates still another embodiment of the invention where the outer flange area 904, half-roll portion 910, and the outer wall 914 are made of one piece and the inner wall 916 and the inner flange 902 are made of another piece. Disposed between the outer wall 914 and the inner wall 916 is a voice coil 18 which is insulated by the two walls but exposed on the bottom side 920. To enclose the bottom side 920, a bottom cover may be coupled to the bottom side to further protect the voice coil 18. One of the advantages with this embodiment is that the two side rolls 914 and 916 protect the voice coil 18 along its side where the damage is most likely to occur.

Figure 10:
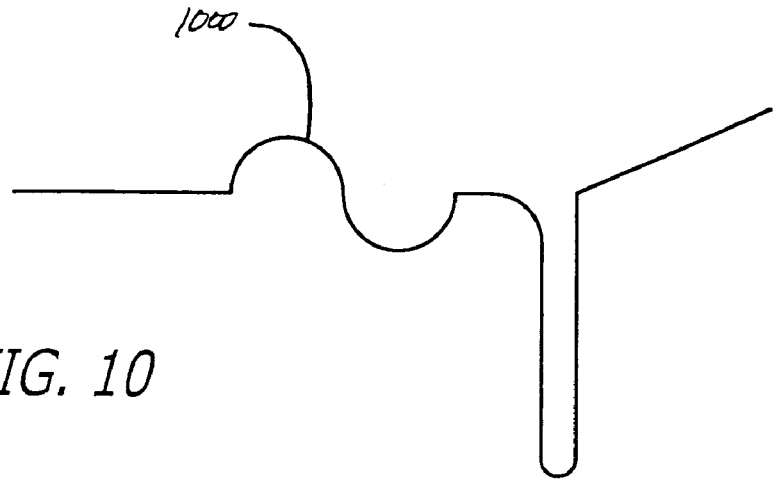
FIG. 10 is a cross-sectional view of an alternative half-roll.
Figure 11:
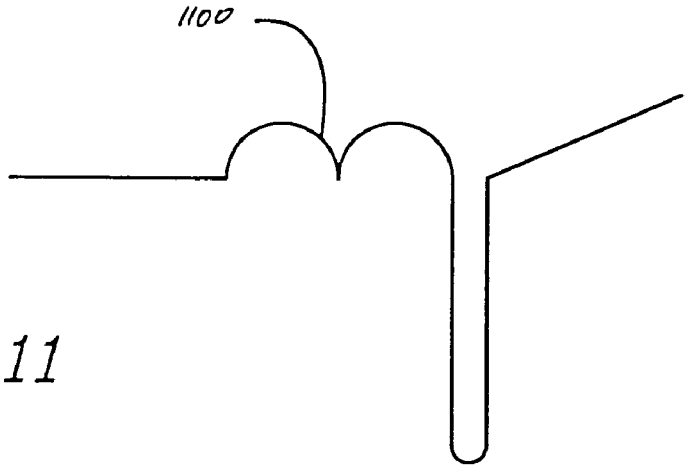
FIG. 11 is a cross-sectional view of an alternative embodiment of a half-roll.
Figure 12:
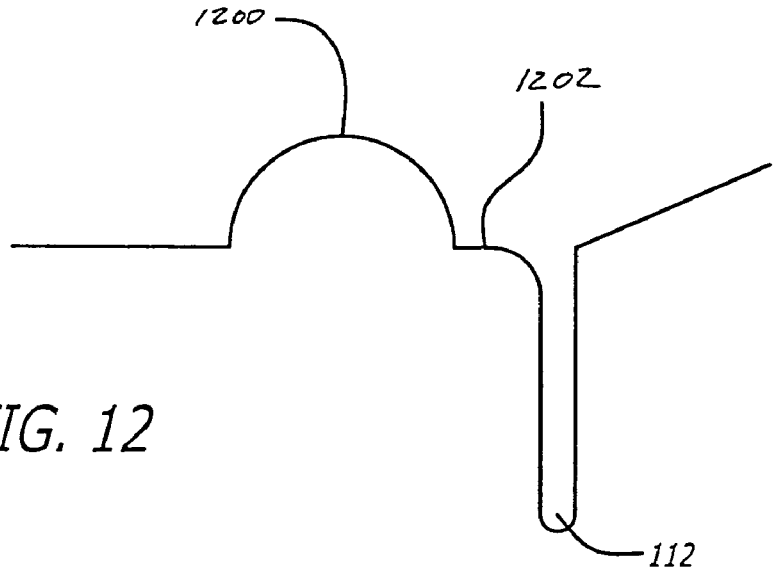
FIG. 12 is a cross sectional view of an alternative embodiment of a unitary suspension pocket attachment.

Although this invention has been described in terms of the embodiments discussed above, numerous modifications and/or additions to the above-described embodiments would be readily apparent to one skilled in the art. For example, as disclosed in FIGS. 10 and 11, the shape of the half-roll may vary, like half-toll 1000 shaped like a sine wave, and a half-roll 1100 shaped like a "m." Still further, as shown by way of example in FIG. 12, an extension 1202 may be formed between the suspension 1200 and the pocket 112.

While various embodiments of the application have been described, it will be apparent to those of ordinary skill in the art that many more embodiments and implementations are possible within the scope of this invention. Accordingly, the invention is not to be restricted except in light of the attached claims and their equivalents.

What is claimed is:

1. A method for adding acoustic energy to a compression driver, comprising:

vibrating an inner flange of a suspension at a predetermined frequency resonance as the suspension oscillates back and forth within a magnetic gap of a phasing plug;

coupling the inner flange to a diaphragm outside of the magnetic gap so that the vibrating of the inner flange causes the diaphragm to add acoustic energy to air between the diaphragm and the phasing plug; and extending the inner flange to form an inner wall that is disposed into the magnetic gap;

tuning the inner flange to vibrate at the predetermined frequency resonance by coupling the diaphragm to the inner flange at a predetermined distance from the inner wall.

2. The method according to claim 1, further coupling the diaphragm along a topside of the inner flange.

3. The method according to claim 1, further coupling the diaphragm along a bottom side of the inner flange so that the diaphragm is closer to a phasing plug.

4. The method according to claim 1, further tuning the inner flange to vibrate at a higher frequency resonance by moving the inner flange closer to the inner wall.

5. The method according to claim 1, further extending the inner wall to form an outer wall where a pocket is formed between the outer wall and the inner wall, where the inner wall and the outer wall are unitary.

6. The method according to claim 5, where the unitary inner and outer walls are formed from KAPTON polyimide material.

7. The method according to claim 5, further including:

inserting a voice coil into the pocket, where the voice coil oscillates within the magnetic gap based on signal currents flowing through the voice coil.

8. A method of adding acoustic energy to a compression driver having a phasing plug, the method comprising:

extending an inner flange from an inner wall of a pocket of a suspension, the pocket adapted to vibrate within a magnetic gap of the phasing plug; and coupling a diaphragm to the inner flange outside of the magnetic gap so that the diaphragm is at a predetermined distance from the inner wall of the pocket, where as the pocket vibrates within the magnetic gap, the inner flange vibrates at a predetermined high frequency resonance to add acoustic energy to the compression driver.

9. The method according to claim 8, further coupling the diaphragm along a topside of the inner flange.

10. The method according to claim 8, further coupling the diaphragm along a bottom side of the inner flange so that the diaphragm is closer to the phasing plug of the compression driver.

11. The method according to claim 8, further tuning the inner flange to vibrate at a higher frequency resonance by shortening the predetermined distance.

12. The method according to claim 8, further extending the inner wall to form an outer wall to form a unitary pocket.

13. The method according to claim 12, where the unitary pocket is formed from KAPTON polymide material.

14. The method according to claim 8, further including:

inserting a voice coil into the pocket, where the voice coil oscillates within the magnetic gap based on signal currents flowing through the voice coil.

* * * * *